US011358220B2

(12) United States Patent
Thomas et al.

(10) Patent No.: US 11,358,220 B2
(45) Date of Patent: Jun. 14, 2022

(54) SEGREGATION MITIGATION WHEN PRODUCING METAL-MATRIX COMPOSITES REINFORCED WITH A FILLER METAL

(71) Applicant: Halliburton Energy Services, Inc., Houston, TX (US)

(72) Inventors: Jeffrey Gerard Thomas, Magnolia, TX (US); Matthew Steven Famy, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 16/610,076

(22) PCT Filed: Mar. 19, 2018

(86) PCT No.: PCT/US2018/023184

§ 371 (c)(1),
(2) Date: Oct. 31, 2019

(87) PCT Pub. No.: WO2018/226286

PCT Pub. Date: Dec. 13, 2018

(65) Prior Publication Data

US 2021/0114100 A1 Apr. 22, 2021

Related U.S. Application Data

(60) Provisional application No. 62/517,808, filed on Jun. 9, 2017.

(51) Int. Cl.
*E21B 10/42* (2006.01)
*B22F 7/06* (2006.01)
(Continued)

(52) U.S. Cl.
CPC ..... *B22F 7/062* (2013.01); *B22F 1/10* (2022.01); *E21B 10/42* (2013.01); *E21B 10/46* (2013.01);
(Continued)

(58) Field of Classification Search
CPC ..... E21B 10/42; E21B 10/46
(Continued)

(56) References Cited

U.S. PATENT DOCUMENTS 5,090,491 A 2/1992 Tibbitts et al.
8,211,203 B2 7/2012 Sheng et al.
(Continued)

FOREIGN PATENT DOCUMENTS

WO 2010096568 8/2010
WO 2016153733 9/2016
(Continued)

OTHER PUBLICATIONS

ISRWO International Search Report and Written Opinion for PCT/US2018/023184 dated Jun. 28, 2018.

*Primary Examiner* — Giovanna Wright
*Assistant Examiner* — Ronald R Runyan
(74) *Attorney, Agent, or Firm* — Thomas Rooney; C. Tumey Law Group PLLC

(57) ABSTRACT

A blend including 50% to 95% reinforcing particles by weight, and 5% to 50% filler particles by weight, of the blend, wherein the reinforcing particles have mean particle size within 70% or less of the mean particle size of the filler particles is disclosed. Such blends can be used to prepare metal matrix composites that can be infiltrated with a binder to form harden composites that can be used for the manufacture of tools.

11 Claims, 4 Drawing Sheets

(51) Int. Cl.
*E21B 10/46* (2006.01)
*B22F 1/10* (2022.01)
*B22F 5/00* (2006.01)

(52) U.S. Cl.
CPC ..... *B22F 2005/001* (2013.01); *B22F 2999/00* (2013.01)

(58) Field of Classification Search
USPC ..... 175/425
See application file for complete search history.

(56) References Cited

U.S. PATENT DOCUMENTS

| | | | | |
|---|---|---|---|---|
| 2008/0101977 | A1 | 5/2008 | Eason et al. | |
| 2010/0101866 | A1 | 4/2010 | Bird | |
| 2010/0116557 | A1* | 5/2010 | Lockwood | E21B 10/55 175/393 |
| 2015/0240566 | A1 | 8/2015 | Amundsen et al. | |
| 2018/0179616 | A1* | 6/2018 | Thomas | E21B 10/46 |

FOREIGN PATENT DOCUMENTS

| | | | | |
|---|---|---|---|---|
| WO | WO-2016153733 | A1 * | 9/2016 | C22C 32/0052 |
| WO | 2017003574 | | 1/2017 | |

* cited by examiner

Density Standard Deviation for Hard Composites

SEGREGATION MITIGATION WHEN PRODUCING METAL-MATRIX COMPOSITES REINFORCED WITH A FILLER METAL

CROSS-REFERENCE TO RELATED APPLICATIONS

This application claims the benefit of and priority to U.S. Provisional Application No. 62/517,808, filed Jun. 9, 2017, the entirety of which is incorporated herein by reference.

BACKGROUND

A wide variety of tools are commonly used in the oil and gas industry for forming wellbores, in completing drilled wellbores, and in producing hydrocarbons from completed wellbores. Examples of such tools include cutting tools, such as drill bits, mills, and borehole reamers. These downhole tools, and several other types of tools outside the realm of the oil and gas industry, are often formed as metal matrix composites (MMCs) and frequently referred to as "MMC tools."

An MMC tool is typically manufactured by depositing matrix reinforcement material into a mold and, more particularly, into a mold cavity defined within the mold and designed to form various external and internal features of the MMC tool. Interior surfaces of the mold cavity, for example, may be shaped to form desired external features of the MMC tool, and temporary displacement materials, such as consolidated sand or graphite, may be positioned within interior portions of the mold cavity to form various internal (or external) features of the MMC tool. A metered amount of binder material is then added to the mold cavity and the mold is then placed within a furnace to liquefy the binder material and thereby allow the binder material to infiltrate the reinforcing particles of the matrix reinforcement material.

MMC tools are generally manufactured to be erosion-resistant and exhibit high impact strength. However, depending on the particular materials used, MMC tools can also be brittle and, as a result, stress cracks can occur as a result of thermal stress experienced during manufacturing or operation, or as a result of mechanical stress experienced during operation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
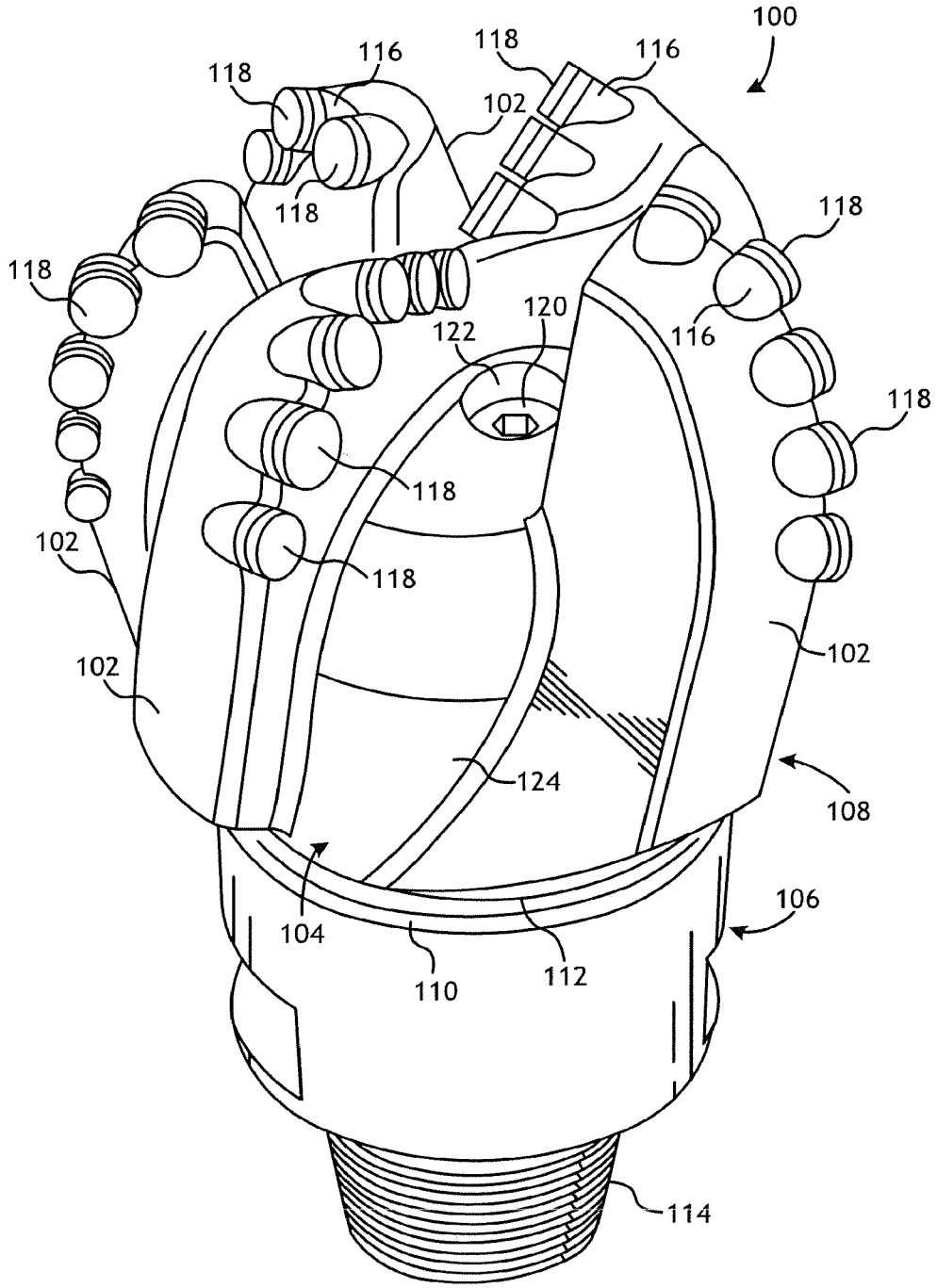
FIG. 1 is a perspective view of an exemplary drill bit that may be fabricated in accordance with the principles of the present disclosure.

The present disclosure relates to metal matrix composites comprising a blend of reinforcing particles and filler particles to form multi-component reinforcement materials.

Such multi-component reinforcement materials can be infiltrated with a binder to form harden composites that can be used for the manufacture of tools.

Reinforcing materials, such as tungsten carbide (WC), have favorable properties that are useful in making drill bits. However, the reinforcing material can be one of the more expensive components of the bit. Because of this, a blend of lower cost material, such as iron or steel, is commonly used.

Due to the large density differences inherent between different materials, the blend incorporating large percentages (such as greater than 20 wt %) of lower cost material may segregate and prevent the blend from future use. The present disclosure provides a solution that minimizes the segregation problem by restricting the relative particle sizes of the reinforcing particles and filler particles.

In certain implementations, the present disclosure relates to a multi-component reinforcement material (a blend) which can be used in tool manufacturing and associated methods of production that mitigate segregation of the components of the multi-component reinforcement material before infiltration.

Embodiments of the present disclosure include the formation of a hard composite for a metal matrix composite tool, where the hard composite is formed by infiltrating a multi-component reinforcement material with a binder.

The multi-component reinforcement material may include reinforcing particles and filler particles that have different compositions and are similarly sized. The size of the reinforcing particles and filler particles may be described based on their relative mean particle size and, optionally, further based on their respective particle size distributions.

As used herein, the term "mean particle size" refers to mean particle size by volume of the particles described. As used herein, the term "particle size distribution" is the number of particles that fall into each of the various size ranges given as a percentage of the total number of all sizes in the sample of interest.

The multi-component reinforcement material may include 50% to 95% reinforcing particles and 5% to 50% filler particles each by weight of the multi-component reinforcement material, wherein the reinforcing particles have a mean particle size within 70% or less of the mean particle size of the filler particles. The mean particle size of the reinforcing particles relative to the mean particle size of the filler particles can be calculated by Formula 1. In some instances, the reinforcing particles may have mean particle size within 65%, 55%, 50%, 45%, 40%, 35%, 30%, 25%, 20%, 15%, 10%, or 5% of the mean particle size of the reinforcing particles as calculated by Formula 1.

$$\frac{|\text{mean particle size of reinforcing particles} - \text{mean particle size of filler particles}|}{\text{mean particle size of filler particles}} \times 100 \qquad \text{Formula 1}$$

As illustrated in the examples below, there is less variability in the density and packing of the multi-component reinforcement material when the mean particle sizes of the components of the multi-component reinforcement material are approximately the same. The lowered variability in the density and packing of the multi-component reinforcement material thus translates to a final metal matrix composite with fewer defects such as cracks and voids.

For example, the relatively same mean particle sizes of the reinforcing particles and filler particles may provide for more homogeneous blending and, or greater packing density of the components, which may translate to greater strength, ductility, toughness, and/or erosion-resistance of the hard composites produced therefrom.

In some embodiments, the reinforcing particles may have a mean particle size ranging from 1 micron to 1000 microns (e.g., from 1 micron to 100 microns, from 10 microns to 250 microns, from 50 microns to 250 microns, from 50 microns to 100 microns, from 100 microns to 250 microns, from 100 microns to 500 microns, from 250 microns to 750 microns, from 250 microns to 1000 microns, or from 500 microns to 1000 microns, in some embodiments).

Suitable reinforcing particles include carbides. More particularly, examples of reinforcing particles suitable for use in conjunction with the embodiments described herein may include particles that include, but are not limited to, silicon carbides, boron carbides, cubic boron carbides, molybdenum carbides, titanium carbides, tantalum carbides, niobium carbides, chromium carbides, vanadium carbides, iron carbides, tungsten carbide (e.g., macrocrystalline tungsten carbide, cast tungsten carbide, crushed sintered tungsten carbide, carburized tungsten carbide, etc.), any mixture thereof, and any combination thereof. In some embodiments, the reinforcing particles may include tungsten carbide (e.g., macrocrystalline tungsten carbide, cast tungsten carbide, crushed sintered tungsten carbide, carburized tungsten carbide, etc.). In some embodiments, the reinforcing particles may be coated. For example, by way of non-limiting example, the reinforcing particles may comprise tungsten carbide coated with titanium.

In some embodiments, the filler particles may have a mean particle size ranging from 1 micron to 1000 microns (e.g., from 1 micron to 100 microns, from 10 microns to 250 microns, from 50 microns to 250 microns, from 50 microns to 100 microns, from 100 microns to 250 microns, from 100 microns to 500 microns, from 250 microns to 750 microns, from 250 microns to 1000 microns, or from 500 microns to 1000 microns, in some embodiments).

Suitable filler particles include particles of metal and metal alloys with a solidus temperature greater than the infiltration processing temperature, which may be around 1500° F., 2000° F., 2500° F., or 3000° F., or any subset or range falling there between. In some embodiments, the infiltration processing temperature is in the range of about 1500° F. to about 3000° F., about 1500° F. to about 2500° F., about 1500° F. to about 2000° F., about 2000° F. to about 3000° F., about 2000° F. to about 2500° F., or about 2500° F. to about 3000° F. In some embodiments, the filler particles include particles of metal and metal alloys with a solidus temperature that is about 50° F., about 75° F., about 100° F., about 150° F., about 200° F., about 250° F., about 300° F., about 350° F., about 400° F., about 450° F., about 500° F., about 600° F., about 700° F., about 800° F., about 900° F., about 1000° F., about 1100° F., about 1200° F., about 1300° F., about 1400° F., about 1500° F., or about 2000° F. greater than the infiltration processing temperature. In some embodiments, the filler particles comprise an alloy having a solidus temperature above 2500° F. or a filler metal having a solidus temperature above 3000° F. Example metals that may be used as the filler particles may be grouped into sets corresponding to the required infiltration processing temperature. Filler metals that have a solidus temperature above 3000° F., for example, include tungsten, rhenium, osmium, tantalum, molybdenum, niobium, iridium, ruthenium, hafnium, boron, rhodium, vanadium, chromium, zirconium, platinum, titanium, and lutetium.

Example metal alloys that may be used as the filler particles include alloys of the aforementioned filler metals, such as tantalum-tungsten, tantalum-tungsten-molybdenum, tantalum-tungsten-rhenium, tantalum-tungsten-molybdenum-rhenium, tantalum-tungsten-zirconium, tungsten-rhenium, tungsten-molybdenum, tungsten-rhenium-molybdenum, tungsten-molybdenum-hafnium, tungsten-molybdenum-zirconium, tungsten-ruthenium, niobium-vanadium, niobium-vanadium-titanium, niobium-zirconium, niobium-tungsten-zirconium, niobium-hafnium-titanium, and niobium-tungsten-hafnium. Additionally, example filler metal alloys include alloys wherein any of the aforementioned filler metals is the most prevalent element in the alloy. Examples for tungsten-based alloys where tungsten is the most prevalent element in the alloy include tungsten-copper, tungsten-nickel-copper, tungsten-nickel-iron, tungsten-nickel-copper-iron, and tungsten-nickel-iron-molybdenum.

Filler metals that have a solidus temperature above 2500° F. include the filler metals listed previously in addition to palladium, thulium, scandium, iron, yttrium, erbium, cobalt, holmium, nickel, silicon, and dysprosium. Example filler metal alloys include alloys of the aforementioned filler metals having a solidus temperature above 2500° F. and the filler metals having a solidus temperature above 3000° F. Example nickel-based alloys include nickel alloyed with vanadium, chromium, molybdenum, tantalum, tungsten, rhenium, osmium, or iridium. Additionally, example filler metal-based alloys include alloys wherein any of the aforementioned filler metals is the most prevalent element in the alloy. Examples for nickel-based alloys where nickel is the most prevalent element in the alloy include nickel-copper, nickel-chromium, nickel-chromium-iron, nickel-chromium-molybdenum, nickel-molybdenum, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), MP98T (i.e., a nickel-copper-chromium superalloy available from SPS Technologies), TMS alloys, CMSX® alloys (i.e., nickel-based superalloys available from C-M Group). Example iron-based alloys include steels, stainless steels, carbon steels, austenitic steels, ferritic steels, martensitic steels, precipitation-hardening steels, duplex stainless steels, and hypo-eutectoid steels.

Filler metals that have a solidus temperature above 2000° F. include the filler metals listed previously in addition to terbium, gadolinium, beryllium, manganese, and uranium. Example filler metal-based alloys include alloys comprised of the aforementioned filler metals having a solidus temperature above 2000° F. and the filler metals having a solidus temperature above 2500° and 3000° F. Additionally, example filler metal-based alloys include alloys wherein any of the aforementioned filler metals having a solidus temperature above 2000° F. is the most prevalent element in the alloy. Example alloys include INCOLOY® alloys (i.e., iron-nickel containing superalloys available from Mega Mex) and hyper-eutectoid steels.

Filler metals that have a solidus temperature above 1500° F. include the filler metals listed previously in addition to copper, samarium, gold, neodymium, silver, germanium, praseodymium, lanthanum, calcium, europium, and ytterbium. Example filler metal-based alloys include alloys comprised of the aforementioned filler metals having a solidus temperature above 1500° F. and the filler metals listed previously having a solidus temperature above 2000° F., 2500° and 3000° F. Additionally, example filler metal-based alloys include alloys wherein any of the aforementioned filler metals having a solidus temperature above 1500° F. is the most prevalent element in the alloy.

In some embodiments, the filler particles are metal or metal alloy particles selected from carbon steels, nickel-iron, molybdenum-iron, chromium-iron, chromium-vanadium-iron, tungsten-iron, nickel-chromium-molybdenum-iron, silicon-manganese-iron, manganese-iron-molybdenum-nickel, iron-molybdenum-nickel, manganese-iron-molybdenum, manganese-iron-nickel, chromium-molybdenum-iron, copper-molybdenum-iron, and nickel-copper-molybdenum-iron.

In some embodiments, the filler particles are selected from atomized unalloyed steel particles, such as Ancorsteel® 1000, Ancorsteel®1000B, Ancorsteel® 1000C, Ancorsteel® AMH, Ancorsteel® 1015, and Ancorsteel® DWP200.

In some embodiments, the filler particles are selected from low alloy sinter-hardening metal powders, such as Ancorsteel® 721 SH, Ancorsteel®737SH, Ancorsteel® 2000, Ancorsteel® 4600V, Ancorsteel® FLD-49DH, and Ancorsteel® FLD-49HP.

In some embodiments, the filler particles are metal or metal alloy particles selected from iron, steel, copper, brass, bronze, manganese, molybdenum, nickel, and alloys thereof, and combinations thereof.

In some embodiments, the reinforcing particles and filler particles may have narrow particle size distributions, which may further mitigate component separation within the multi-component reinforcement material and, consequently, enhance the properties of the resultant hard composite.

In some embodiments, the reinforcing particles may have a particle size distribution that is less than 30% of the mean particle size of the reinforcing particles (e.g., less than 10%, in some embodiments). In some embodiments, the reinforcing particles may have a particle size distribution that is within at least 30 microns of the mean particle size of the reinforcing particles (e.g., less than 15 microns, in some embodiments).

In some embodiments, the filler particles may have a particle size distribution that is less than 30% of the mean particle size of the filler particles (e.g., less than 10%, in some embodiments). In some embodiments, the filler particles may have a particle size distribution that is within at least 30 microns of the mean particle size of the filler particles (e.g., less than 15 microns, in some embodiments).

In some embodiments, the concentration of the filler particles in the multi-component reinforcement material may be up to 50% by weight of the multi-component reinforcement material (e.g., 1% to 50%, 5% to 50%, 10% to 50%, 10% to 25%, 15% to 30%, 20% to 50%, 20% to 40%, 20% to 30%, or 30% to 50%, in some embodiments). In some embodiments, the concentration of the reinforcing particles in the multi-component reinforcement material may be at least 50% by weight of the multi-component reinforcement material (e.g., 60% to 99%, 60% to 90%, 75% to 90%, 50% to 80%, 50% to 70%, 60% to 80%, 70% to 80%, or 60% to 70%, in some embodiments).

Exemplary compositions of the reinforcing particles and filler particles are provided further herein.

In some instances, blending of the reinforcing particles and filler particles may include multiple steps to provide a more homogenous multi-component reinforcement material having a greater packing density in a mold used in production of the hard composite. In some instance, vibrating or agitating may be used to increase the packing density of the multi-component reinforcement material in the mold where the relative mean particles sizes of the reinforcing particles and filler particles advantageously reduces segregation of the various components of the multi-component reinforcement material.

Once blended, the multi-component reinforcement material may be used to produce a hard composite for a metal matrix composite tool.

Embodiments of the present disclosure includes a method comprising blending the reinforcing particles and the filler particles to form the multi-component reinforcement material disclosed herein, installing the multi-component reinforcement material in a mold; and infiltrating the multi-component reinforcement material with a binder to form a hard composite. In some embodiments, the hard composite has a transverse rupture strength (TRS) value above 100 ksi. The hard composite can be characterized by a density distribution, in which the hard composite has a mean or average density with a density distribution around the mean. The distribution can have a range that runs from a minimum density up to a maximum density. In addition, the distribution can be characterized by a density deviation (standard deviation of the density from the mean). In some embodiments, the density deviation of the hard composite is less than 0.60, such as less than 0.5, 0.4, 0.3, 0.2, or 0.1.

Suitable binders include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-zinc-manganese-aluminum-lead, copper-aluminum-nickel-zinc-tin-iron, and the, like, and any combination thereof. Examples of commercially-available binder materials 232 include, but are not limited to, VIRGIN' Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling.

While the composition of some of the filler particles and binders may overlap, one skilled in the art would recognize that the composition of the filler fibers should be chosen to have a melting point greater than the hard composite portion production temperature, which is at or higher than the melting point of the binder.

Embodiments of the present disclosure are applicable to any tool, part, or component formed as a metal matrix composite (MMC). For instance, the principles of the present disclosure may be applied to the fabrication of tools or parts commonly used in the oil and gas industry for the exploration and recovery of hydrocarbons. Such tools and parts include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

Embodiments of the present disclosure include for example, a drill bit, comprising a bit body; and a plurality of cutting elements coupled to an exterior of the bit body, wherein at least a portion of the bit body comprises a hard composite portion that comprises a multi-component reinforcement material infiltrated with a binder, wherein the multi-component reinforcement material comprises reinforcing particles and filler particles, wherein the amount of the reinforcing particles ranges from 50 to 95% by weight of the multi-component reinforcement material, and the amount of the filler particles ranges from 5 to 50% by weight of the multi-component reinforcement material, wherein the reinforcing particles have a mean particle size within 70% or less of the mean particle size of the filler particles. The mean particle size of the reinforcing particles relative to the mean particle size of the filler particles is determined using Formula 1:

$$\frac{|\text{mean particle size of reinforcing particles} - \text{mean particle size of filler particles}|}{\text{mean particle size of filler particles}} \times 100. \quad \text{Formula 1}$$

Thus, when the mean particles size of the filler particles is the same as the mean particle size of the reinforcing particles, Formula 1 will show that the two sizes are within 0% of one another. Similarly, if the mean particle size of the reinforcing particles is about 90 μm and the mean particles size of the filler particles is about 100 μm, according to Formula 1, the mean particle size of the reinforcing particles are calculated to be within |90 μm−100 μm|/(100 μm)×100=10% of the mean particle size of the filler particles.

The principles of the present disclosure, however, may be equally applicable to any type of MMC used in any industry or field. For instance, the methods described herein may also be applied to fabricating armor plating, automotive components (e.g., sleeves, cylinder liners, driveshafts, exhaust valves, brake rotors), bicycle frames, brake fins, wear pads, aerospace components (e.g., landing-gear components, structural tubes, struts, shafts, links, ducts, waveguides, guide vanes, rotor-blade sleeves, ventral fins, actuators, exhaust structures, cases, frames, fuel nozzles), turbopump and compressor components, a screen, a filter, and a porous catalyst, without departing from the scope of the disclosure. Those skilled in the art will readily appreciate that the foregoing list is not a comprehensive listing, but only exemplary. Accordingly, the foregoing listing of parts and/or components should not be limiting to the scope of the present disclosure.

Referring to FIG. 1, illustrated is a perspective view of an example MMC tool 100 that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100," but as indicated above, the drill bit 100 may alternatively be replaced with any type of MMC tool or part used in the oil and gas industry or any other industry, without departing from the scope of the disclosure.

As illustrated in FIG. 1, the drill bit 100 may provide a plurality of cutter blades 102 angularly spaced from each other about the circumference of a bit head 104. The bit head 104 is connected to a shank 106 to form a bit body 108. The shank 106 may be connected to the bit head 104 by welding, such as through laser arc welding that results in the formation of a weld 110 around a weld groove 112. The shank 106 may further include a threaded pin 114, such as an American Petroleum Institute (API) drill pipe thread used to connect the drill bit 100 to drill pipe (not shown).

In the depicted example, the drill bit 100 includes five cutter blades 102 in which multiple recesses or pockets 116 are formed. A cutting element 118 (alternately referred to as a "cutter") may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a string of drill pipe (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each angularly adjacent pair of cutter blades 102. Cuttings, downhole debris, formation fluids, drilling fluid, etc. may flow through the junk slots 124 and circulate back to the well surface within an annulus formed between exterior portions of the string of drill pipe and the inner wall of the wellbore being drilled.

Figure 2:
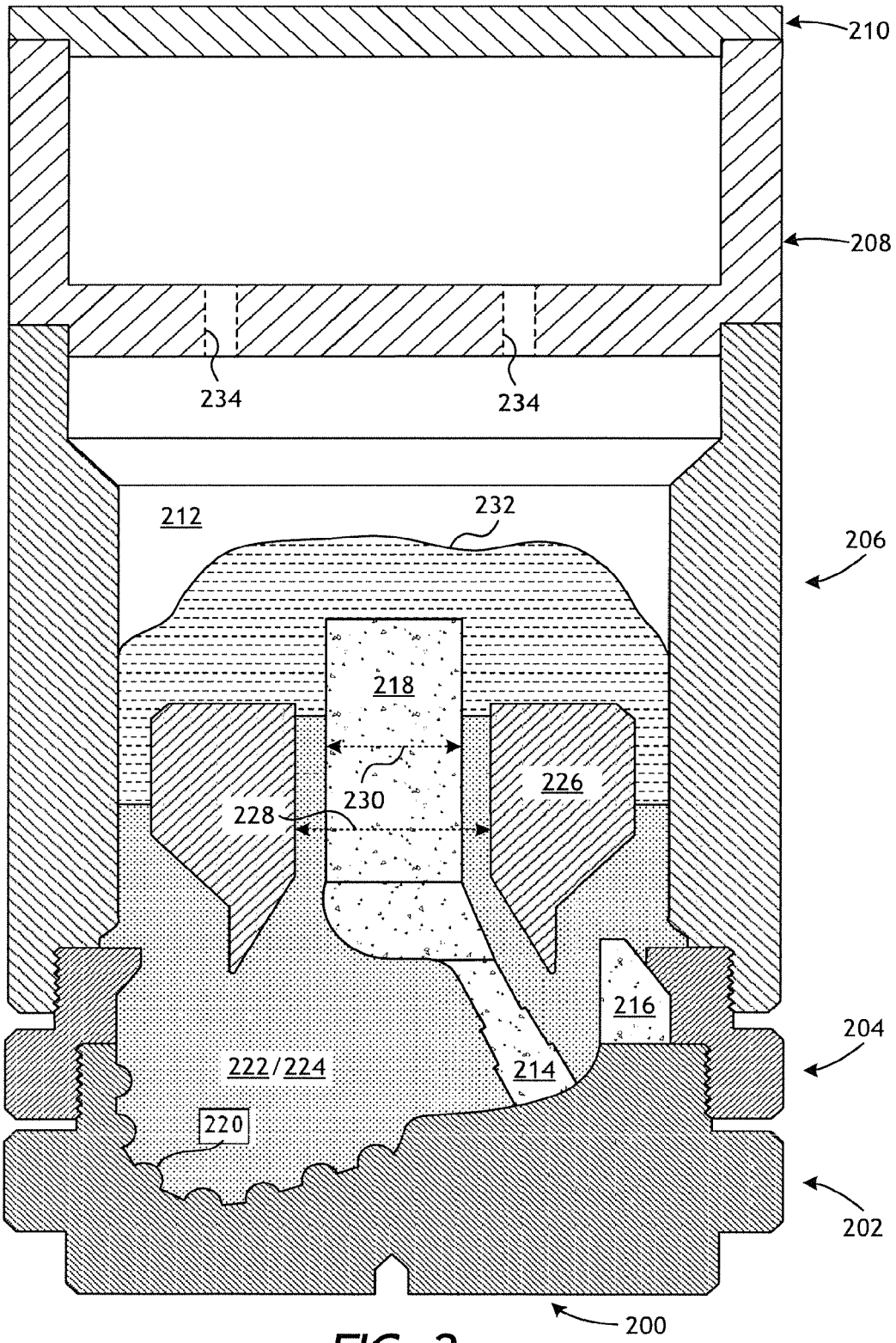
FIG. 2 is a cross-sectional side view of an exemplary mold assembly used to form the drill bit of FIG. 1.

FIG. 2 is a cross-sectional side view of a mold assembly 200 that may be used to form the drill bit 100 of FIG. 1. While the mold assembly 200 is shown and discussed as being used to help fabricate the drill bit 100, a variety of variations of the mold assembly 200 may be used to fabricate any of the MMC tools mentioned above, without departing from the scope of the disclosure. As illustrated, the mold assembly 200 may include several components such as a mold 202, a gauge ring 204, and a funnel 206. In some embodiments, the funnel 206 may be operatively coupled to the mold 202 via the gauge ring 204, such as by corresponding threaded engagements, as illustrated. In other embodiments, the gauge ring 204 may be omitted from the mold assembly 200 and the funnel 206 may instead be operatively coupled directly to the mold 202, such as via a corresponding threaded engagement, without departing from the scope of the disclosure.

In some embodiments, as illustrated, the mold assembly 200 may further include a binder bowl 208 and a cap 210 placed above the funnel 206. The mold 202, the gauge ring 204, the funnel 206, the binder bowl 208, and the cap 210 may each be made of or otherwise comprise graphite or alumina ($Al_2O_3$), for example, or other suitable materials. An infiltration chamber 212 may be defined within the mold assembly 200. Various techniques may be used to manufacture the mold assembly 200 and its components including, but not limited to, machining graphite blanks to produce the various components and thereby define the infiltration chamber 212 to exhibit a negative or reverse profile of desired exterior features of the drill bit 100 (FIG. 1).

Materials, such as consolidated sand or graphite, may be positioned within the mold assembly 200 at desired locations to form various features of the drill bit 100 (FIG. 1). For example, one or more nozzle or leg displacements 214 (one shown) may be positioned to correspond with desired locations and configurations of flow passageways defined through the drill bit 100 and their respective nozzle openings (i.e., the nozzle openings 122 of FIG. 1). One or more junk slot displacements 216 may also be positioned within the mold assembly 200 to correspond with the junk slots 124 (FIG. 1). Moreover, a cylindrically shaped central displacement 218 may be placed on the leg displacements 214. The number of leg displacements 214 extending from the central displacement 218 will depend upon the desired number of flow passageways and corresponding nozzle openings 122 in the drill bit 100. Further, cutter-pocket displacements 220 may be defined in the mold 202 or included therewith to form the cutter pockets 116 (FIG. 1). In the illustrated embodiment, the cutter-pocket displacements 220 are shown as forming an integral part of the mold 202.

After the desired displacement materials have been installed within the mold assembly 200, a multi-component reinforcement material that includes reinforcing particles 222 dispersed with filler particles 224 may then be placed within or otherwise introduced into the mold assembly 200. As used herein, the term "dispersed" can refer to a homogeneous or a heterogeneous mixture or combination of two or more materials, which in this example is the multi-component reinforcement material including reinforcing particles 222 and the filler particles 224. The multi-component reinforcement material may prove advantageous in adding strength and ductility to the resulting drill bit 100 (FIG. 1) and may also improve erosion resistance.

In some embodiments, a mandrel 226 (alternately referred to as a "metal blank") may be supported at least partially by the reinforcing particles 222 and the filler particles 224 within the infiltration chamber 212. More particularly, after a sufficient volume of the reinforcing particles 222 and the filler particles 224 has been added to the mold assembly 200, the mandrel 226 may be situated within mold assembly 200. The mandrel 226 may include an inside diameter 228 that is greater than an outside diameter 230 of the central displacement 218, and various fixtures (not expressly shown) may be used to properly position the mandrel 226 within the mold assembly 200 at a desired location. The blend of the reinforcing particles 222 and the filler particles 224 may then be filled to a desired level within the infiltration chamber 212 around the mandrel and the central displacement 218.

At any time, including at multiple times or continuously, during instillation of the multi-component reinforcement material into the mold assembly 200, the mold assembly 200 may be vibrated, shaken, or tapped to increase packing density of the multi-component reinforcement material.

A binder material 232 may then be placed on top of the mixture of the reinforcing particles 222 and the filler particles 224, the mandrel 226, and the central displacement 218. In some embodiments, the binder material 232 may be covered with a flux layer (not expressly shown). The amount of binder material 232 (and optional flux material) added to the infiltration chamber 212 should be at least enough to infiltrate the reinforcing particles 222 and the filler particles 224 during the infiltration process. In some instances, some or all of the binder material 232 may be placed in the binder bowl 208, which may be used to distribute the binder material 232 into the infiltration chamber 212 via various conduits 234 that extend therethrough. The cap 210 (if used) may then be placed over the mold assembly 200.

The mold assembly 200 and the materials disposed therein may then be preheated and subsequently placed in a furnace (not shown). When the furnace temperature reaches the melting point of the binder material 232, the binder material 232 will liquefy and proceed to infiltrate the reinforcing particles 222 and the filler particles 224. After a predetermined amount of time allotted for the liquefied binder material 232 to infiltrate the reinforcing particles 222 and the filler particles 224, the mold assembly 200 may then be removed from the furnace and cooled at a controlled rate.

Figure 3:
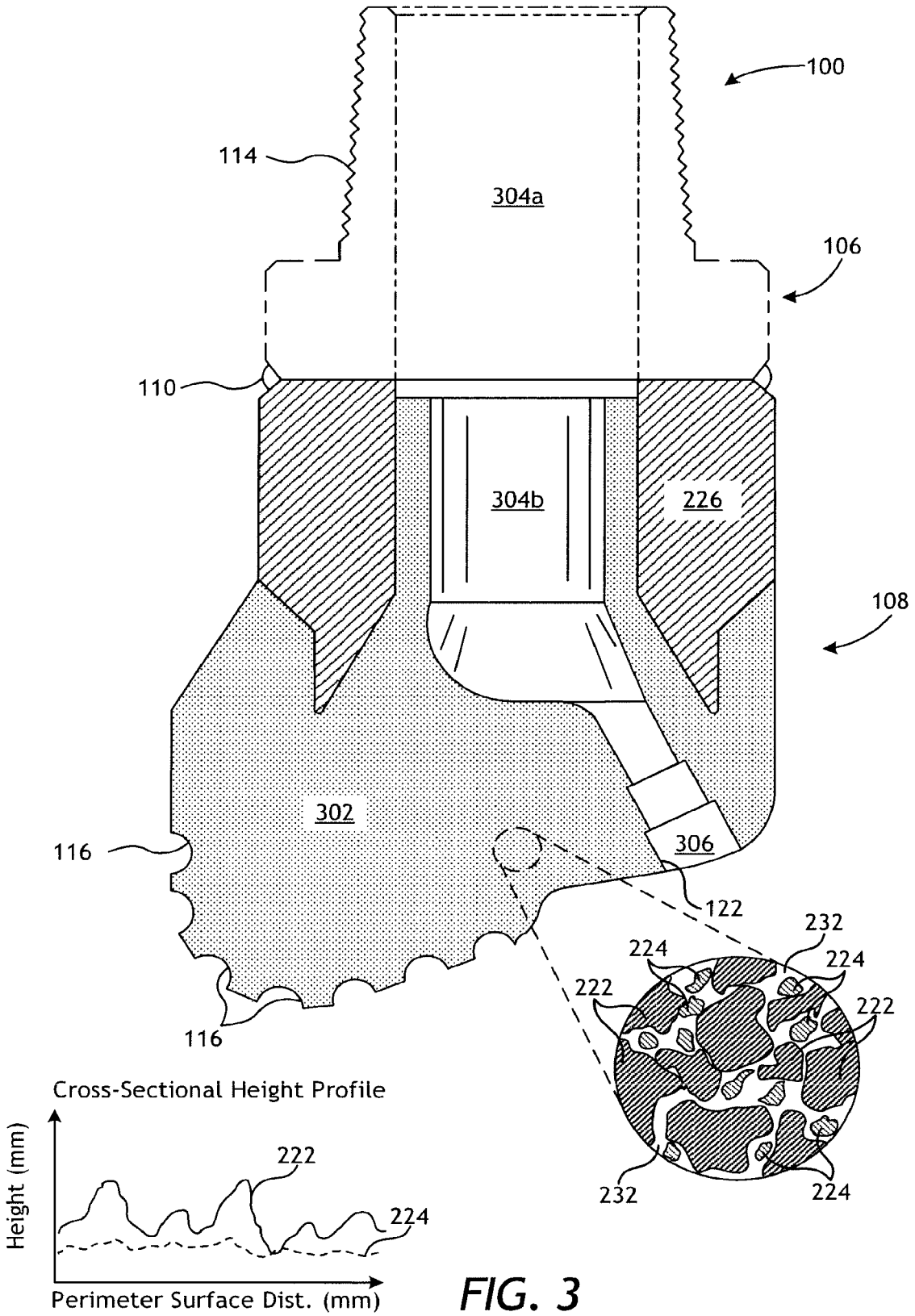
FIG. 3 is a cross-sectional view of the drill bit of FIG. 1.

FIG. 3 is a cross-sectional side view of the drill bit 100 of FIG. 1 following the above-described infiltration process within the mold assembly 200 of FIG. 2. Similar numerals from FIG. 1 that are used in FIG. 3 refer to similar components or elements that will not be described again. Once cooled, the mold assembly 200 of FIG. 2 may be broken away to expose the bit body 108, which now includes a hard composite portion 302.

As illustrated, the shank 106 may be securely attached to the mandrel 226 at the weld 110 and the mandrel 226 extends into and forms part of the bit body 108. The shank 106 defines a first fluid cavity 304*a* that fluidly communicates with a second fluid cavity 304*b* corresponding to the location of the central displacement 218 (FIG. 2). The second fluid cavity 304*b* extends longitudinally into the bit body 108, and at least one flow passageway 306 (one shown) may extend from the second fluid cavity 304*b* to exterior portions of the bit body 108. The flow passageway(s) 306 correspond to the location of the leg displacement(s) 214 (FIG. 2). The nozzle openings 122 (one shown in FIG. 3) are defined at the ends of the flow passageway(s) 306 at the exterior portions of the bit body 108, and the pockets 116 are depicted as being formed about the periphery of the bit body 108 and are shaped to receive the cutting elements 118 (FIG. 1).

As shown in the enlarged detail view of FIG. 3, the hard composite portion 302 may comprise the reinforcing particles 222 having the filler particles 224 dispersed therewith and infiltrated with the binder material 232. The finished bit body 108, therefore, contains a volume of filler metal-reinforced material, which may prove advantageous in improving material strength, preventing crack propagation, and/or increasing capacity for strain energy absorption (i.e., higher toughness). Also, the addition of the filler particles 224 may prove advantageous in facilitating easier machining, grinding, and finishing of the infiltrated metal matrix composite material or tool.

The reinforcing particles 222 and the filler particles 224 may be distinguished by physical properties like failure strain, shear modulus, and solidus temperature. These physical property distinctions may provide for the improved strength, ductility, and erosion resistance of the resulting drill bit 100.

As used herein, the term "failure strain" refers to the strain reached by a material at ultimate failure, which may be determined by tensile testing according to ASTM E8-15a for the filler particles 224 or ASTM C1273-15 for the reinforcing particles 222. The reinforcing particles 222 may have a failure strain of 0.01 or less (e.g., 0.001 to 0.01, 0.005 to 0.01, or 0.001 to 0.005). The filler particles 224 may have a failure strain of at least 0.05 (e.g., 0.05 to 0.5, 0.1 to 0.5, or 0.05 to 0.1). In some instances, the failure strain of the reinforcing particles 222 may be at least five times less than the failure strain of the filler particles 224 (e.g., 5 to 100 times less, 5 to 50 time less, 5 to 25 times less, 10 to 50 times less, or 25 to 100 times less).

As used herein, the term "shear modulus" refers to the ratio of the shear force applied to a material divided by the deformation of the material under shear stress, which may be determined by ASTM E1875-13 for the filler particles 224 or ASTM C1259-15 for the reinforcing particles 222 using a monolithic sample for each rather than a particle. The reinforcing particles 222 may have a shear modulus of greater than 200 GPa (e.g., greater than 200 GPa to 1000 GPa, greater than 200 GPa to 600 GPa, 400 GPa to 1000 GPa, 600 GPa to 1000 GPa, or 800 GPa to 1000 GPa). The filler particles 224 may have a shear modulus of 200 GPa or less (e.g., 10 GPa to 200 GPa, 10 GPa to 100 GPa, or 100 GPa to 200 GPa). In some instances, the shear modulus of the reinforcing particles 222 may be at least two times greater than the shear modulus of the filler metal components 320 (e.g., 2 to 40 times greater, 2 to 10 times greater, 5 to 25 times greater, 10 to 40 times greater, or 25 to 40 times greater).

Further, a surface roughness of the filler particles 224 may be smoother than the reinforcing particles 222, which may provide faster binder infiltration of the multi-component reinforcement material or tighter spacing of the multi-component reinforcement material. These advantages may result in a shorter heating or furnace cycle and more consistent strength, ductility, and erosion resistance properties in the hard composite portion 302. Surface roughness may be used as a measure of the smoothness of the individual particles of the filler particles 224 and the individual reinforcing particles 222. As used herein, the term "surface roughness" refers to the average peak-to-valley distance as determined by laser profilometry of the particle surfaces. Surface roughness of particles may depend on the size of the particles. In some instances, the surface roughness of the reinforcing particles 222 may be at least two times greater than (i.e., have a surface roughness at least two times greater than) the surface roughness of the filler particles 224 (e.g., 2 to 25 times greater, 5 to 10 times greater, or 10 to 25 times greater).

The inset bar chart shown in FIG. 3 provides an exemplary cross-sectional height profile comparison between the reinforcing particles 222 and the filler particles 224. More specifically, the bar chart compares the average perimeter surface height (y-axis) with the distance around the perimeter surface (x-axis). The peaks and valleys depicted in the bar chart correspond to the varying magnitude of the surface roughness as measured about the outer perimeter of the reinforcing particles 222 and the filler particles 224, respectively. The average peak-to-valley distance is calculated as the average peak height minus the average valley height. As can be seen in the bar chart, the reinforcing particles 222 may exhibit average peak-to-valley distances that are at least two times greater than the average peak-to-valley distance of the filler particles 224. This equates to the reinforcing particles 222 having a surface roughness of at least two times that of the filler metal component.

While any of the reinforcing particles 222 mentioned herein may be suitable for use in the multi-component reinforcement material, one common type of reinforcing particle 222 is a tungsten carbide (WC) powder. However, WC, like carbide materials in general, can be hard and brittle. As such, it is sensitive to defects and prone to catastrophic failure. Strength metrics for hard materials, such as WC, are highly statistical in preventing such failures, and carbide size and quality can also dramatically impact the performance of an MMC tool.

The filler particles 224 may comprise a filler metal as powder, particulate, shot, or a combination of any of the foregoing. As used herein, the term "shot" refers to particles having a diameter greater than 4 mm (e.g., greater than 4 mm to 16 mm). As used herein, the term "particulate" refers to particles having a diameter of 250 microns to 4 mm. As used herein, the term "powder" refers to particles having a diameter less than 250 microns (e.g., 0.5 microns to less than 250 microns).

In some embodiments, the filler particles 224 described herein may have a mean particle size ranging from a lower limit of 1 micron, 10 microns, 50 microns, or 100 microns to an upper limit of 16 mm, 10 mm, 5 mm, 1 mm 500 microns, or 250 microns or 100 microns, wherein the mean particle size of the filler particles 224 may range from any lower limit to any upper limit and encompasses any subset therebetween.

While certain metal powders have been added to multi-component reinforcement materials as an infiltration aid (e.g., binder), the filler particles 224 mixed with the reinforcing particles 222 of the present disclosure works in a fundamentally different way since the filler particles 224 do not melt into the continuous binder phase in the resulting MMC tool. In most cases, the filler particles 224 do not inter-diffuse with the binder phase to an appreciable extent, thereby leaving the filler particles 224 to remain as ductile third-phase particles in the resulting MMC tool after the infiltration process.

In one specific embodiment, the reinforcing particles 222 may comprise tungsten carbide (WC) and the filler particles 224 may comprise a iron/steel powder or steel shot.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Embodiments disclosed herein include:

A. A method comprising: blending reinforcing particles and filler particles to form a multi-component reinforcement material, wherein an amount of the reinforcing particles ranges from 50 to 95% by weight of the multi-component reinforcement material, and an amount of the filler particles ranges from 5 to 50% by weight of the multi-component reinforcement material, wherein the reinforcing particles have a mean particle size within 70% or less of the mean particle size of the filler particles; loading the multi-component reinforcement material in a mold; and infiltrating the multi-component reinforcement material with a binder to form a hard composite.

B. A blend comprising 50% to 95% reinforcing particles by weight, and 5% to 50% filler particles by weight, of the blend, wherein the reinforcing particles have mean particle size within 70% or less of the mean particle size of the filler particles.

C. A drill bit, comprising: a bit body; and a plurality of cutting elements coupled to an exterior of the bit body, wherein at least a portion of the bit body comprises a hard composite portion that comprises a multi-component reinforcement material infiltrated with a binder, wherein the multi-component reinforcement material comprises reinforcing particles and filler particles, wherein the amount of the reinforcing particles ranges from 50 to 95% by weight of the multi-component reinforcement material, and the amount of the filler particles ranges from 5 to 50% by weight of the multi-component reinforcement material, wherein the reinforcing particles have a mean particle size within 70% or less of the mean particle size of the filler particles.

Each of embodiments A, B, and C may have one or more of the following additional elements in any combination, unless otherwise provided for: Element 1: wherein the reinforcing particles comprise tungsten carbide particles; Element 2: wherein the filler particles comprise a metal or metal alloy particles selected from iron, steels, copper, brass, bronze, manganese, molybdenum, nickel, and alloys thereof, and combinations thereof; Element 3: wherein the filler particles are 20% to 40% by weight of the multi-component reinforcement material; Element 4: wherein the reinforcing particles have a mean particle size ranging from 1 to 1000 microns; Element 5: wherein the filler particles have a mean particle size ranging from 1 to 1000 microns; Element 6: wherein the hard composite has an infiltrated density standard deviation of less than 0.60. Element 7: wherein the reinforcing particles have a mean particle size within 65% of the mean particle size of the filler particles.

To facilitate a better understanding of the embodiments described herein, the following examples of preferred or representative embodiments are given. In no way should the following examples be read to limit, or to define, the scope of the disclosure.

Example 1

Three blends, i.e., multi-component reinforcement material, were prepared. TABLE 1 below lists the components thereof, including the reinforcing particles, filler particles, mean particle size thereof, and weight percentage of filler particles.

TABLE 1

Components of Blend Nos. 1-3

| Blend No. | Reinforcing particles/size | Filler particles/size | Percentage (Filler particles, wt) |
|---|---|---|---|
| 1 | Tungsten carbide/ 107.8 μm | Steel/iron 116.3 μm | 15% |
| 2 | Tungsten carbide/ 107.8 μm | Steel/iron 116.3 μm | 30% |
| 3 | Tungsten carbide/ 303.7 μm | Steel shot 300 μm | 30% |

Powder analysis using a Microtrac particle analyzer showed the particle size distribution (PSD) of the blends. The PSD of Blend No. 1 and Blend No. 2 did not deviate far from the base tungsten carbide (WC). Blend No. 3 showed a very similar PSD to its base WC powder up to the 275 μm range. The PSD for Blend No. 3 plateaued from 275-315 μm but then had a similar slope as the base WC, then shifted larger till 600 μm as compared to the base WC powder.

Each of the blends was infiltrated with binder and run through a production furnace. TABLE 2 lists the density of infiltrated blends. Hard Composite No. 1 (HC No. 1), Hard Composite No. 2 (HC No. 2), and Hard Composite No. 3 (HC No. 3) correspond to infiltrated Blend No. 1, Blend No. 2, and Blend No. 3, respectively.

TABLE 2

Density of infiltrated blends (in units of g/cm$^3$)

| | Average | Std Dev | Median | Max | Min |
|---|---|---|---|---|---|
| HC No. 1 | 10.53 | 0.09 | 10.52 | 10.70 | 10.39 |
| HC No. 2 | 9.98 | 0.04 | 9.99 | 10.02 | 9.92 |
| HC No. 3 | 9.72 | 0.16 | 9.76 | 9.85 | 9.54 |

Each of the HC Nos. 1-3 had small variability in density as evidenced by the density standard deviation. The small variability is an indication of reduced settling. HC Nos 1-3 are considered to be suitable for the manufacture of tools.

TRS (transverse rupture strength) samples were sectioned out of infiltrated Blend No. 1 (HC No. 1) and infiltrated Blend No. 2 (HC No. 2). TABLE 3 shows the TRS value of the infiltrated blends.

TABLE 3

TRS Values (KSI)

| | Average KSI | Std Dev | Median | Max | Min |
|---|---|---|---|---|---|
| Infiltrated Blend No. 1 | 139035 | 4696 | 140057 | 147206 | 131307 |
| Infiltrated Blend No. 2 | 135219 | 7436 | 133389 | 149209 | 125007 |

The blends for HC No. 1, HC No. 2, and HC No. 3 show these blends can be processed to have normal infiltration and strength based on TRS and microstructure data and can be viable, low cost powder blends.

Example 2

Three additional blends, i.e., multi-component reinforcement material, were prepared. TABLE 4 below lists the components thereof, including the reinforcing particles, filler particles, mean particle size thereof, and weight percentage of filler particles.

TABLE 4

Components of Blend Nos. 4-5

| Blend No. | Reinforcing particles/size | Filler particles/size | Percentage (Filler particles, wt) |
|---|---|---|---|
| 4 | Tungsten carbide/ 103.6 μm | Steel shot/ 531.9 μm | 35% |
| 5 | Tungsten carbide/ 413.3 μm | Steel/ 295.4 μm | 30% |
| 6 | Tungsten carbide/ 107.8 μm | Steel shot/ 300.0 μm | 30% |

Similar to Blend Nos. 1-3, Blend Nos. 4-6 were infiltrated with a binder and run through a furnace process. Hard Composite No. 4 (HC No. 4), Hard Composite No. 5 (HC No. 5), and Hard Composite No. 6 (HC No. 6) correspond to infiltrated Blend No. 4, Blend No. 5, and Blend No. 6, respectively.

Figure 4:
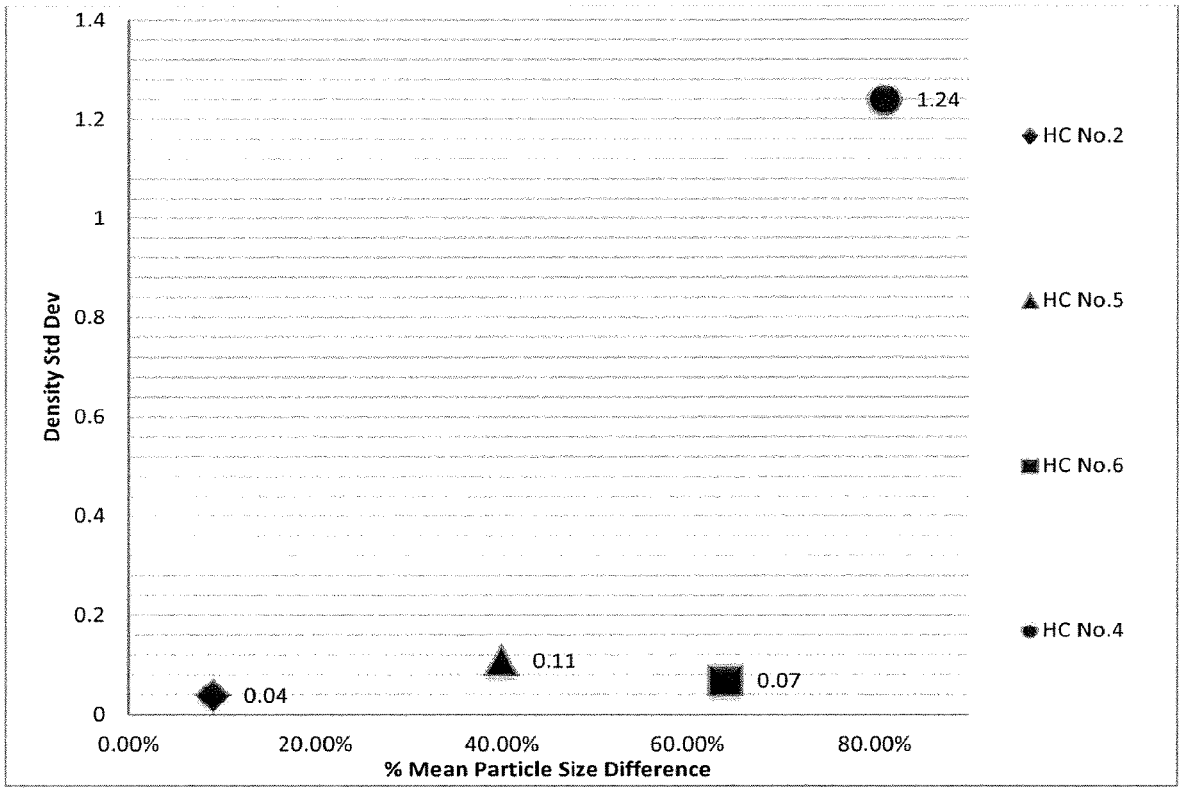
FIG. 4 is a density standard deviation of hard composites.

FIG. 4 shows a density standard deviation chart measured for HC No. 2 and HC Nos 4-6. The x-axis represents the mean particle size percentage difference between the filler particles and reinforcing particles according to Formula 1. Blend Nos. 2, 5, and 6 had mean particle size percentage differences as 7.3%, 40.0%, and 64.1%, respectively. The density standard deviations for the corresponding HC Nos. 2, 5, and 6 were 0.04, 0.11, and 0.07, respectively. The small variability in the density standard deviation shown by HC Nos 2, 5, and 6 indicate a suitability for the manufacture of tools.

Blend No. 4 had a mean particle size percentage difference as 80.5%. The density standard deviation for the corresponding HC No. 4 was 1.24, which was too high for HC No. 4 to be suitable for the manufacture of tools. This large density standard deviation for Blend No. 4 is an indication that a component separation of the filler particles and the reinforcing particles has occurred. Consequently, the blend would form an inhomogeneous hard composite, which in turn increases the susceptibility of a MMC tool to stress cracks during operation. Thus, a mean particle size percentage difference of 80.5% in the blend is shown to result in separation and be inadequate for use in the manufacture of tools. In contrast, the corresponding hard composites for Blend Nos. 2, 5, and 6, each of which had a mean particle size percentage difference of less than 70.0%, unexpectedly showed density standard deviations that were at least 11 times smaller than that of HC No. 4 (1.24 for HC No. 4 divided by 0.11 for HC No. 6). This data indicates that a mean particle size percentage difference of 70.0% or less is critical to preventing component separation in a blend of filler particles and reinforcing particles as described herein. Moreover, the reduction in component separation enables the manufacture of tools comprising improved hard composites that are less susceptible to stress cracking.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A drill bit, comprising:

a bit body; and a plurality of cutting elements coupled to an exterior of the bit body, wherein at least a portion of the bit body comprises a hard composite portion that comprises a multi-component reinforcement material infiltrated with a binder, wherein the multi-component reinforcement material comprises a blend of reinforcing particles and filler particles, wherein the filler particles comprise a metal or metal alloy material, wherein an amount of the reinforcing particles ranges from 50 to 80% by weight of the multi-component reinforcement material, and an amount of the filler particles ranges from 20 to 50% by weight of the multi-component reinforcement material, and wherein the reinforcing particles have a mean particle size within 70% or less of the mean particle size of the filler particles.

2. The drill bit of claim 1, wherein the reinforcing particles comprise tungsten carbide particles.

3. The drill bit of claim 1, wherein the metal or metal alloy material of the filler particles is selected from the group consisting of iron, steels, copper, brass, bronze, manganese, molybdenum, nickel, alloys thereof, and combinations thereof.

4. The drill bit of claim 1, wherein the reinforcing particles have a mean particle size within 65% of the mean particle size of the filler particles.

5. The drill bit of claim 1, wherein the reinforcing particles have a mean particle size within 50% or less of the mean particle size of the filler particles.

6. The drill bit of claim 1, wherein the reinforcing particles have a mean particle size within 10% or less of the mean particle size of the filler particles.

7. The drill bit of claim 1, wherein the blend of reinforcing particles and filler particles comprises 20% to 40% by weight of the filler particles.

8. The drill bit of claim 1, wherein the reinforcing particles have a mean particle size ranging from 1 to 1000 microns.

9. The drill bit of claim 1, wherein the filler particles have a mean particle size ranging from 1 to 1000 microns.

10. The drill bit of claim 1, wherein the hard composite has a density standard deviation of less than 0.60 g/cm3.

11. A drill bit, comprising:

a bit body; and a plurality of cutting elements coupled to an exterior of the bit body, wherein at least a portion of the bit body comprises a hard composite portion that comprises a multi-component reinforcement material infiltrated with a binder, wherein the multi-component reinforcement material comprises a blend of reinforcing particles and filler particles, wherein the reinforcing particles comprise tungsten carbide particles, wherein the filler particles comprise a metal or metal alloy selected from the group consisting of iron, steels, copper, brass, bronze, manganese, molybdenum, nickel, alloys thereof, and combinations thereof, wherein an amount of the reinforcing particles ranges from 50 to 80% by weight of the multi-component reinforcement material, and an amount of the filler particles ranges from 20 to 50% by weight of the multi-component reinforcement material, wherein the reinforcing particles have a mean particle size within 70% or less of the mean particle size of the filler particles, and wherein the filler particles have a mean particle size ranging from 50 to 500 microns.

* * * * *